US005551359A

United States Patent [19]

Ikeda

[11] Patent Number: 5,551,359

[45] Date of Patent: Sep. 3, 1996

[54] UNDER TRIMMING DEVICE FOR A MULTI-NEEDLE MULTI-LOOPER SEWING MACHINE

[75] Inventor: Kenji Ikeda, Tao-Yuan Hsien, Taiwan

[73] Assignee: Kaulin Mfg. Co., Ltd., Taipei, Taiwan

[21] Appl. No.: 518,162

[22] Filed: Aug. 23, 1995

[51] Int. Cl.[6] ..... D05B 65/00

[52] U.S. Cl. ..... 112/292; 112/286

[58] Field of Search ..... 112/286, 287, 112/291, 292, 295, 298, 300, 301, 253, DIG. 2, 63; 83/901, 905, 910

[56] References Cited

U.S. PATENT DOCUMENTS

| | | | |
|---|---|---|---|
| 1,401,465 | 12/1921 | De Voe | 112/298 |
| 3,371,632 | 3/1968 | Snyder et al. | 112/286 X |
| 4,461,229 | 7/1984 | Angele et al. | 112/291 |
| 5,125,351 | 6/1992 | Prais et al. | 112/63 X |

FOREIGN PATENT DOCUMENTS

| | | |
|---|---|---|
| 75208857 | 9/1975 | Taiwan . |
| 81107878 | 10/1981 | Taiwan . |

*Primary Examiner*—Ismael Izagurre
*Attorney, Agent, or Firm*—Clifford W. Browning; Woodard Emhardt; Naughton Moriarty & McNett

[57] ABSTRACT

An under trimming device for a multi-needle sewing machine with multiple longitudinally extended loopers mainly including a cutting part and a clamping part. Both the cutting and the clamping parts are longitudinally and reciprocatingly movable, so that multiple looper threads may be pulled by multiple movable catchers of the cutting part into the clamping part before they and corresponding needle threads are simultaneously cut by a fixed cutter of the cutting part, permitting free ends of the cut threads to have uniform length and being held at the same position.

5 Claims, 9 Drawing Sheets

UNDER TRIMMING DEVICE FOR A MULTI-NEEDLE MULTI-LOOPER SEWING MACHINE

BACKGROUND OF THE INVENTION

The present invention relates to an under trimming device for a multi-needle sewing machine with longitudinally extended looper, and more particularly to an under trimming device for a multi-needle sewing machine with multiple longitudinally extended loopers to simultaneously cut looper threads and needle threads respectively threading through different loopers and needles and make the cut threads have free ends with the same length. The under trimming device according to the present invention may effectively avoid the device from coming into collision with or interfering with the needles, loopers, and other accessories of the sewing machine, permitting the sewing machine to have stable thread cutting and simplified assembling.

A multi-needle sewing machine is widely used in the sewing industry. In which, multiple needles over a-needle plate of the sewing machine are used to guide multiple needle threads while multiple loopers below the needle plate, which have the same numbers and position corresponding to those of the multiple needles, are used to guide multiple looper threads. The needles and the loopers move alternately to complete the sewing, that is, the so-called chain sewing. Since the sewing principle and procedures are not the point of the present invention, they are not discussed herein.

The under trimming device of the present invention is used with a multi-needle sewing machine with multiple longitudinally extended loopers. In this type of sewing machine, a looper thereof sways back and forth in the sewing direction to guide the looper thread. The technical issue to be discussed in the present invention is: how to automatically cut the needle threads and the- looper threads at the time the sewing is completed with the cut needle threads and looper threads being positioned in place and having free ends with the same length so as to facilitate the next sewing.

Most of the conventional multi-needle sewing machines have an under trimming device which sways at an angle relative to the sewing direction so as to catch the needle threads and the looper threads and pull the same to a predetermined position to cut them off. Alternatively, a cutting device is disposed to the side of and in perpendicular to the sewing direction to reciprocate in one single direction so as to catch the needle threads and the looper threads and pull them to a predetermined position for cutting off. R.O.C. (Taiwan) Utility Model Patent Application No. 75208857 discloses an under trimming device for a multi-needle sewing machine, in which a driving means is used to drive a catcher of the under trimming device to travel at an angle relative to the sewing direction so as to hook, cut, and clamp the needle threads and the looper threads. R.O.C. (Taiwan) Patent Application No. 81107878 discloses a method of trimming threads of sewing machine and an under trimming device thereof, in which an under trimming device is disposed to one side of the sewing line to reciprocate diagonally and thereby hooks and cuts the needle threads and the looper threads.

The following disadvantages are found in the conventional under trimming devices for a multi-needle sewing machine:

1. The member used to catch or hook the needle threads and the looper threads sways in a curved track and thus easily comes into collision with the loopers and becomes damaged.
2. To clamp free ends of the cut threads and hold the same in place, the member for catching the needle threads or the looper threads must not be disposed too far away from the needle plate of the sewing machine. Instead, the catch mender must be considerably close to the needle plate to ensure the clamping of threads. However, the close position of the catch member to the needle plate tends to interfere with the movement of the catch member while the distant position of the catch member from the needle plate tends to give too long free ends of the cut threads.
3. An under trimming device either moving angularly or reciprocating laterally shall cause the cut threads to have free ends of different lengths which is obviously adverse to a successful start of the next sewing operation.

The above described disadvantages become more serious in a multi-needle sewing machine with longitudinally extended loopers. It is therefore tried by the inventor to develop an under trimming device for such sewing machine to eliminate the above disadvantages.

SUMMARY OF THE INVENTION

It is a primary object of the present invention to provide a new under trimming device for a multi-needle sewing machine with longitudinally extended loopers in which multiple looper threads can be clamped in place before they and the needle threads are cut at the same time and fixed to a predetermined place for the next sewing operation.

Another object of the present invent ion is to provide a new under trimming device for a multi-needle sewing machine with longitudinally extended loopers in which the cut threads have free ends in the same length which facilitate a successful start of the next sewing operation.

A further object of the present invention is to provide a new under trimming device for a multi-needle sewing machine with longitudinally extended loopers in which simple assembling without requiring additional space can be achieved and is therefore helpful to a compact design of the sewing machine.

A still further object of the present invention is to provide a new under trimming device for a multi-needle sewing machine with longitudinally extended loopers in which operations of the needles, loopers, and other members of the sewing machine are not interfered by the under trimming device.

The under trimming device according to the present invention mainly includes a cutting part and a clamping part. The cutting part is disposed in front of the needle plate of the sewing machine and mainly includes a fixed cutter and a plurality of movable catchers (the number of movable catchers is decided depending on that of the needles of sewing machine). A pneumatically or electromagnetically driven transmission mechanism is used to drive the movable catchers to move forward and catch the needle threads and the looper threads and pull the same back to an initial position so that the threads are cut off by the fixed cutter. The clamping part is disposed below the needle plate and mainly includes a plurality of looper and looper thread claw assemblies (the number of the assemblies is also decided depending on that of the movable catchers and of the needles). The clamping part operates in a manner corresponding to the movements of the cutting part. Looper threads are clamped on thread claws of the looper and looper thread claw assemblies by means of claw leaf springs and holding pins thereof. The cutting part is driven by the transmission mechanism to return to its initial position, the needle threads and the looper threads caught and pulled backward by the movable catchers are cut by the fixed cutter with the free ends of the cut looper threads being clamped on the thread claws in a standby position for the next sewing operation. Moreover, an air blower disposed at one side of the needles is used to blow the cut needle threads to the needle plate in a standby position for the next sewing operation. Furthermore, a thread push plate with fingers is disposed between the needle plate and the cutting part to reciprocate laterally and thereby widely expand loops formed from the looper threads to facilitate the extending of the movable catchers through the loops to catch the latter.

BRIEF DESCRIPTION OF THE DRAWINGS

The features and functions of the present invent ion can be best understood from the following detailed description of the preferred embodiment and the accompanying drawings, wherein.

DETAILED DESCRIPTION OF THE PREFERRED EMBODIMENT

Figure 1:
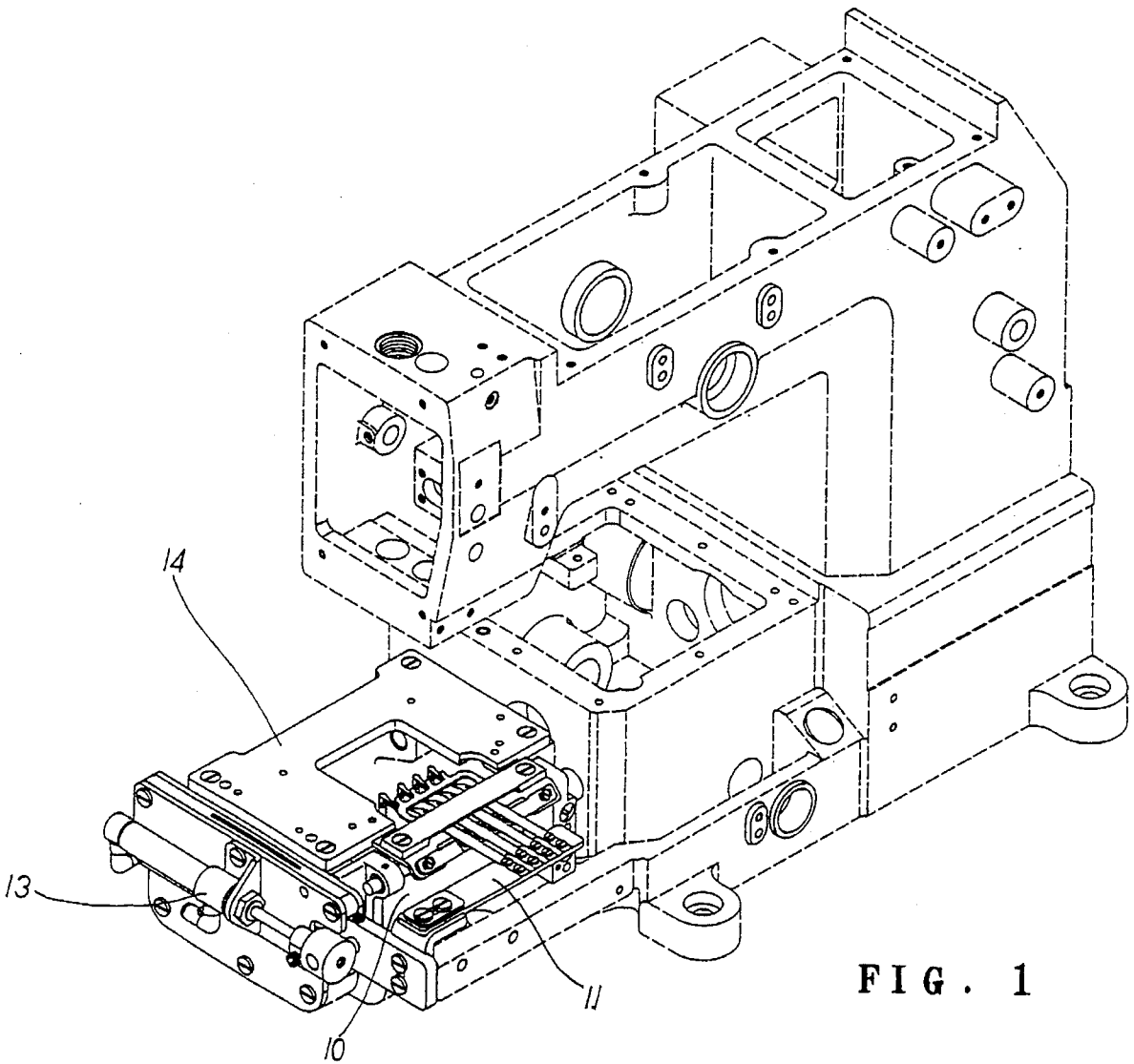
FIG. 1 is a perspective view showing the location of the under trimming device of the present invention in a multi-needle sewing machine with multiple longitudinally extended loopers.

The present invention relates to an under trimming device 10 for a multi-needle sewing machine with multiple longitudinally extended loopers. However, as shown in FIG. 1, an embodiment of the present invention used with a four-needle sewing machine is illustrated and the details thereof will now be described hereafter.

The under trimming device 10 is disposed in the end portion of the bed of the sewing machine and immediately below the four needles of the sewing machine. A pneumatically or electro-magnetically driven transmission mechanism 13 is disposed at the endmost portion of the machine bed to actuate a cutting part 11 of the under trimming device 10 to move reciprocatingly.

Figure 2:
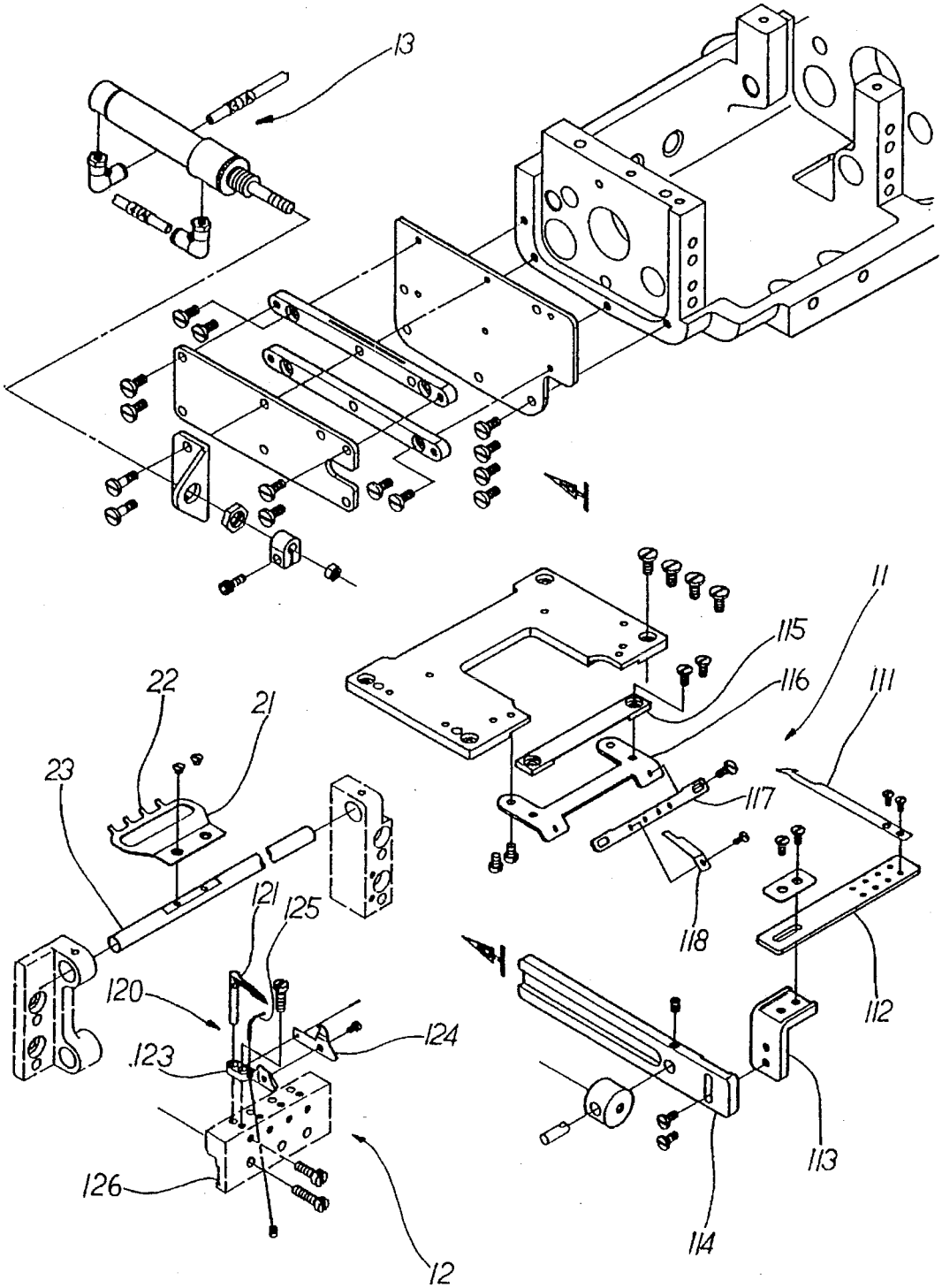
FIG. 2 is an exploded perspective view of the under trimming device for a multi-needle sewing machine with multiple longitudinally extended loopers according to the present invention.

Please refer to FIG. 2, the under trimming device 10 according to the present invention mainly includes a cutting part 11 and a clamping part 12.

Figure 3:
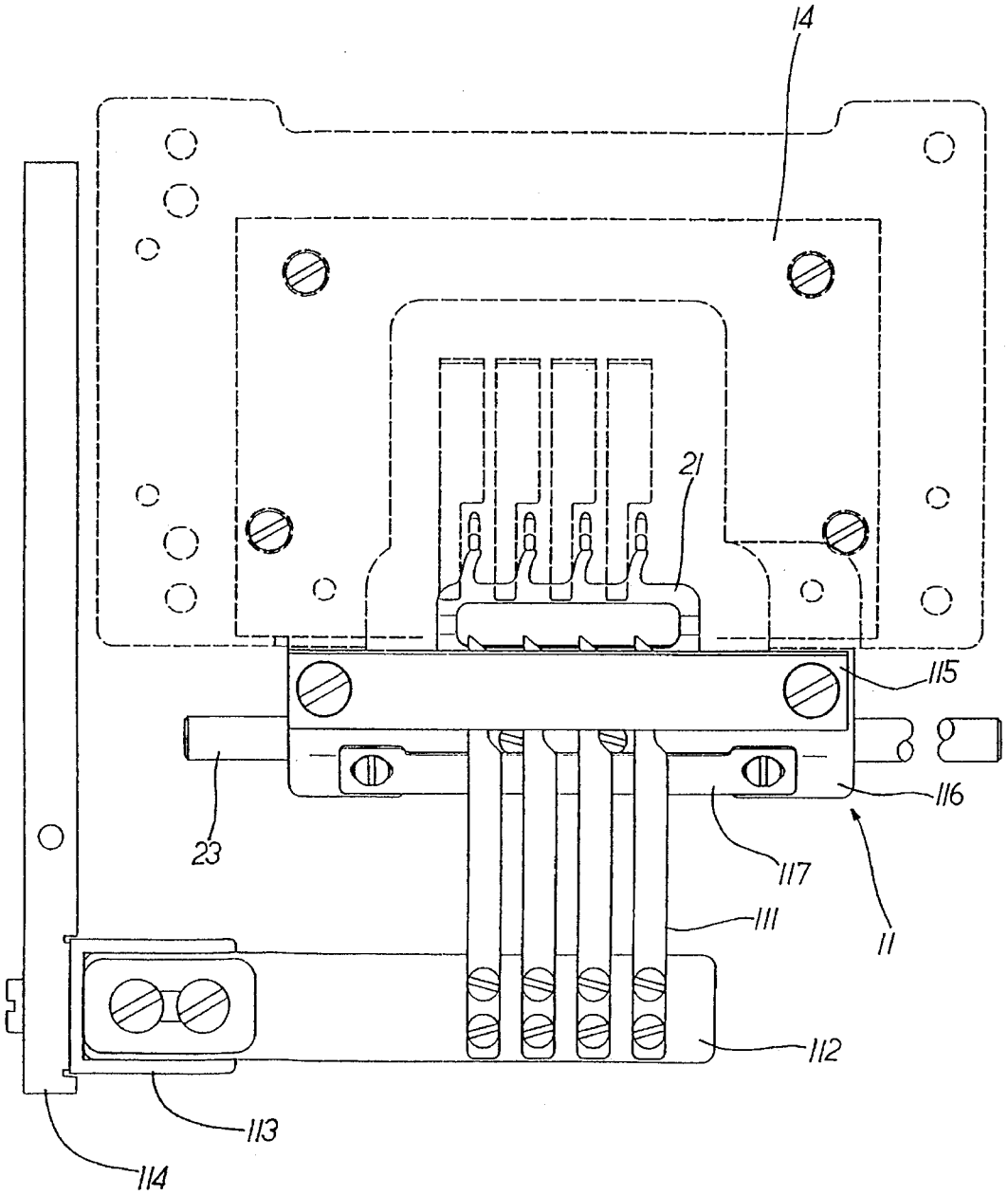
FIG. 3 is a fragmentary, enlarged, top plan view showing the cutting part of the under trimming device wherein the movable catchers are at their initial positions.
Figure 4:
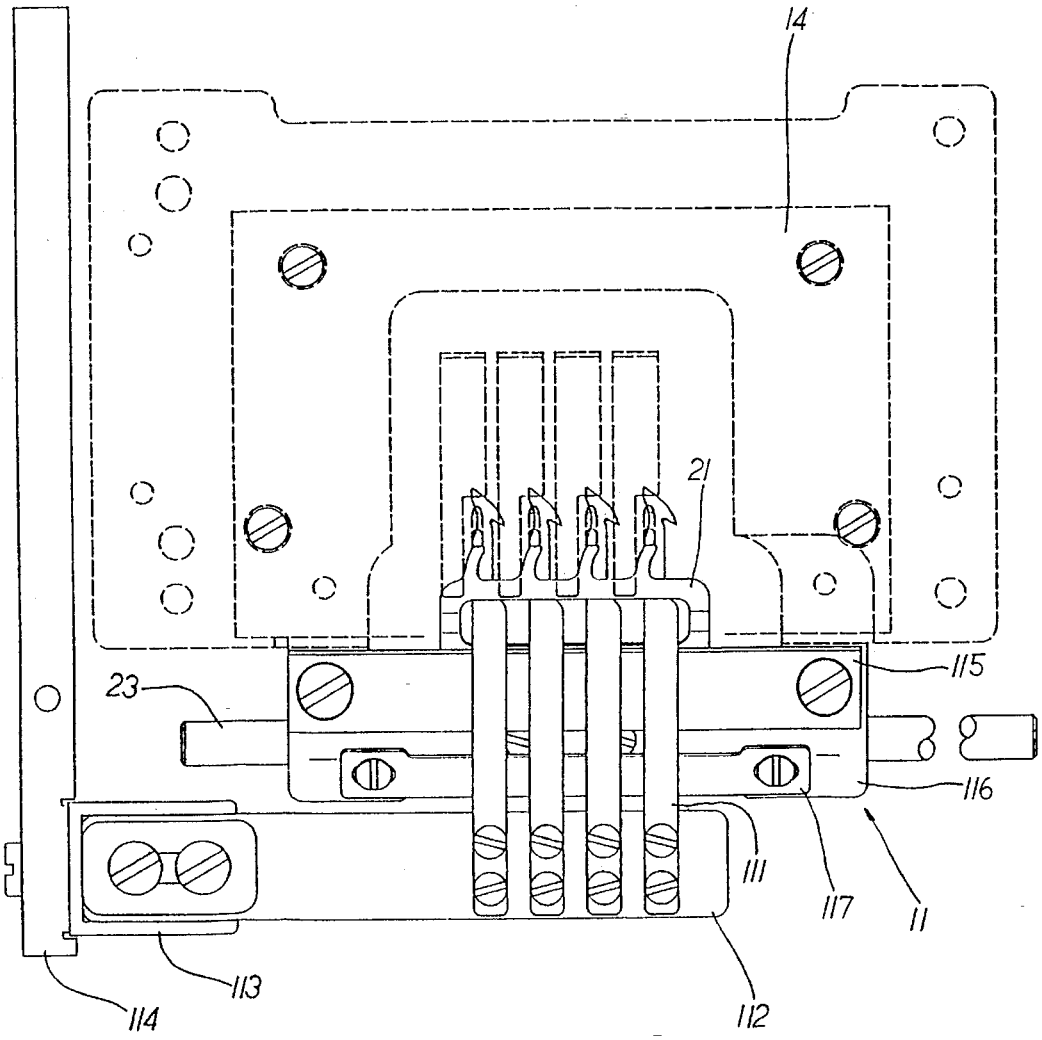
FIG. 4 is a fragmentary, enlarged, top plan view showing the cutting part of the under trimming device wherein the movable catchers are at their extended positions.

Please further refer to FIGS. 2, 3, and 4, the cutting part 11 is located in front of a needle plate 14 of the sewing machine. In the present embodiment, the cutting part 11 has four movable catchers 111 which are fixed to a movable-catcher holder 112 by means of screws and are retained at their predetermined positions. The movable-catcher holder 112 is associated with a link 114 via an L-shaped connecting member 113. The link 114 is connected to the above-mentioned transmission mechanism 13 so as to actuate the movable catchers 111 to move reciprocatingly.

The cutting part 11 further has a fixed cutter 115 which is mounted on a substantially H-shaped fixed cutter holder 116. The fixed cutter holder 116 is disposed in front of the needle plate 14 by means of screws such that the fixed cutter 115 is disposed immediately in front of the needle plate 14. The fixed cutter holder 116 is so formed that two projections thereof facing the movable catchers 111 are inclinedly bent downward to receive a leaf spring mount 117 thereon by means of screws. Leaf springs 118 are mounted on the mount 117 so that they respectively press against the bottom side of the movable catchers 111, as more clearly shown in FIGS. 10 and 11. The number and positions of the leaf springs 118 correspond to those of the movable catchers 111 so as to maintain the movable catchers 111 in a horizontal position.

Figure 5:
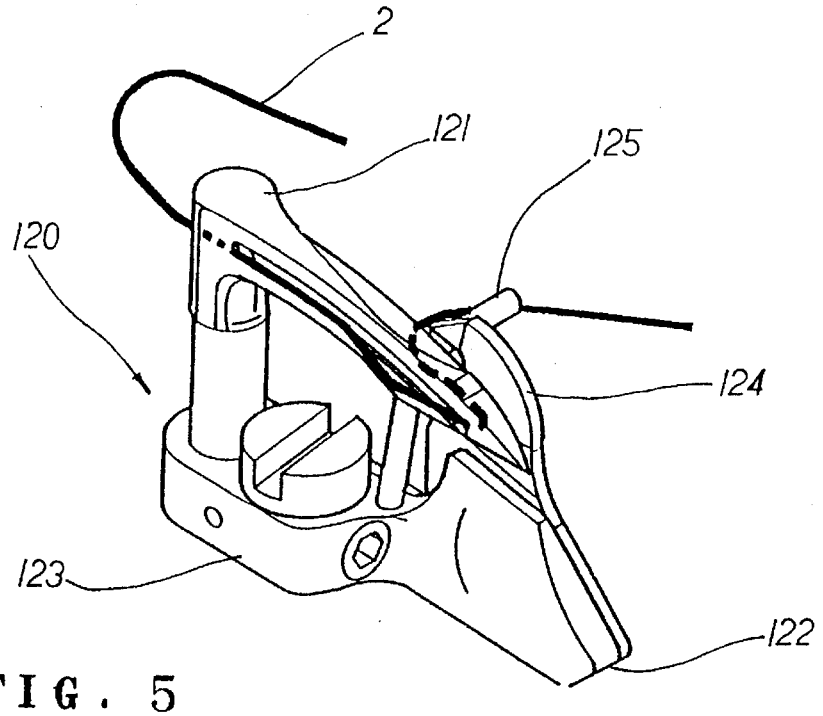
FIG. 5 is a fragmentary, enlarged, perspective view showing a looper and looper thread claw assembly of the clamping part of the under trimming device, wherein a looper thread is clamped between a leaf spring and a holding pin of the looper thread claw.
Figure 6:
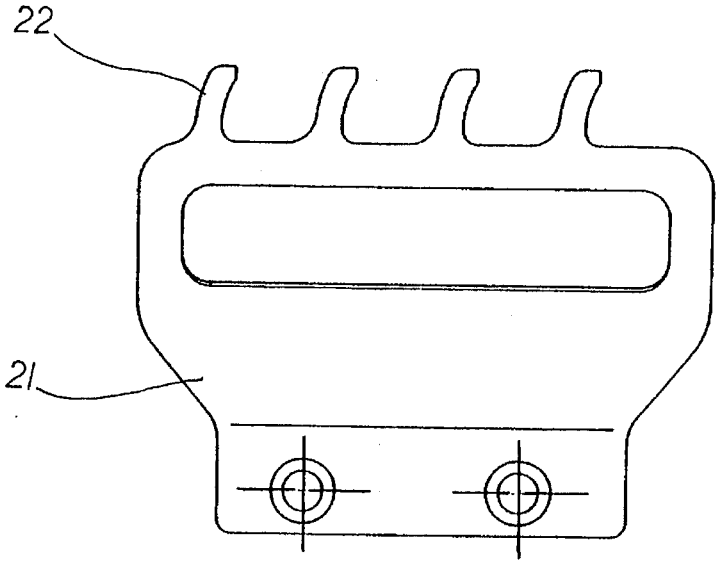
FIG. 6 is a plan view showing the thread push plate of the present invention.
Figure 7:
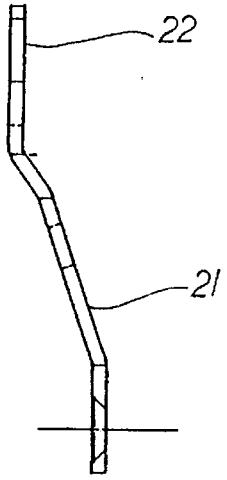
FIG. 7 is a right side view of the thread push plate shown in FIG. 6.

Please now refer to FIGS. 2 and 5 at the same time. The clamping part 12 is located beneath the needle plate 14 with the cutting part 11 in front of it and mainly includes four looper and looper thread claw assemblies 120. The looper and looper thread claw assemblies 120 are located below the four movable catchers 111 of the cutting part 11. A looper 121 is provided on each assembly 120. A looper thread 2 threads through a hole formed at the rear end of each looper 121. Each assembly 120 further has a looper thread claw 122 which consists of a claw base 123, a claw leaf spring 124, and a holding pin 125. The holding pin 125 is disposed on the claw base 123 to abut against the claw leaf spring 124. The looper 121 is also disposed on the claw base 123.

Figure 10:
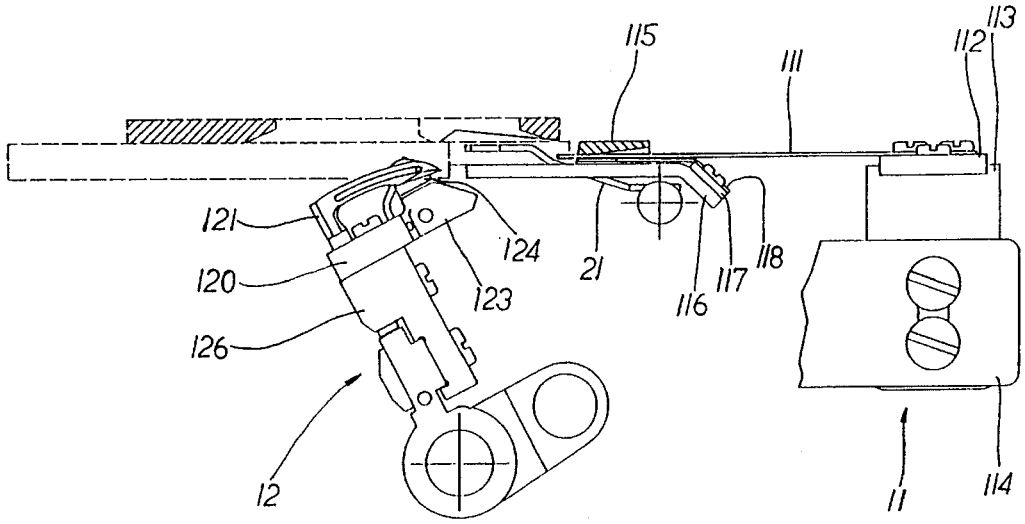
FIG. 10 is a left side view showing the position of the clamping part relative to the cutting part when the movable catchers are at their initial positions.
Figure 11:
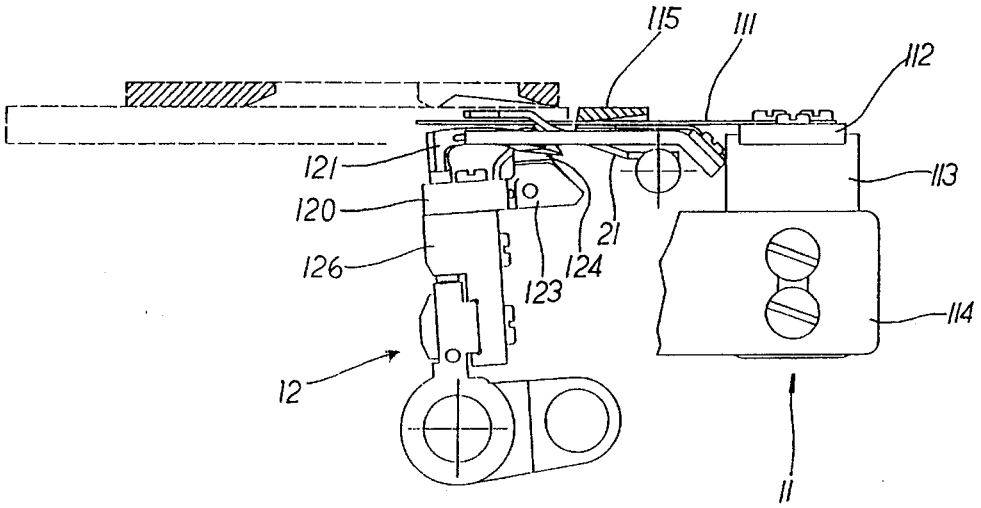
FIG. 11 is a left side view showing the position of the clamping part relative to the cutting part when the movable catchers are at their extended positions to a dead point thereof.

The looper and looper thread claw assemblies 120 are fixed to a mounting block 126 and are retained to a predetermined position. As shown in FIGS. 10, 11, the mounting block 126 is connected to a looper driving mechanism of the sewing machine so that the whole clamping part 12 is brought to move reciprocatingly while the loopers 121 form loops. Since this belongs to the prior art, it will not be further described herein.

Now, please refer to FIGS. 2, 3, 4, and 6 at the same time. An integrally formed thread push plate 21 is disposed in front of the needle plate 14. The thread push plate 21 is formed with four fingers 22 with which looper threads 2 are pushed to form expanded loops. The thread push plate 21 is fixed to a transmission shaft 23 located below the fixed cutter 115 of the cutting part 11. The transmission shaft 23 is driven by the transmission mechanism of the sewing machine to reciprocate laterally and thereby brings the thread push plate 21 to reciprocate laterally, too.

Figure 17:
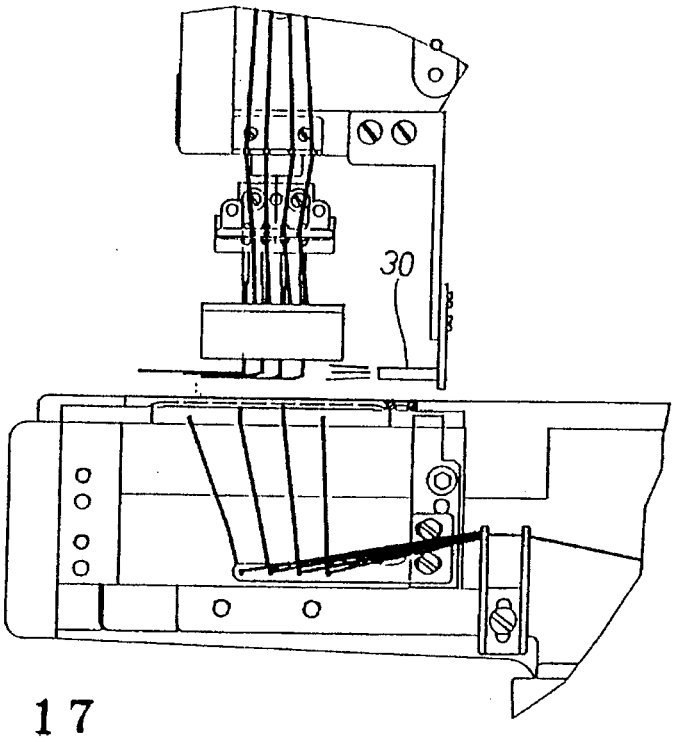
FIG. 17 is a front elevational view showing that the free ends of the cut needle threads are blown to one side by an air blower when the under trimming device of the present invention has completed its one cycle of thread trimming on the multi-needle sewing machine with multiple longitudinally extended loopers.

Refer to FIG. 17 now. An air blower 30 is provided to the right side of needles of the sewing machine to blow the free ends of cut needle threads leftward to facilitate the next sewing operation.

Following is a detailed description of the operation of the under trimming device 10 of the present invention for sewing machine with multiple longitudinally extended loopers.

Figure 8:
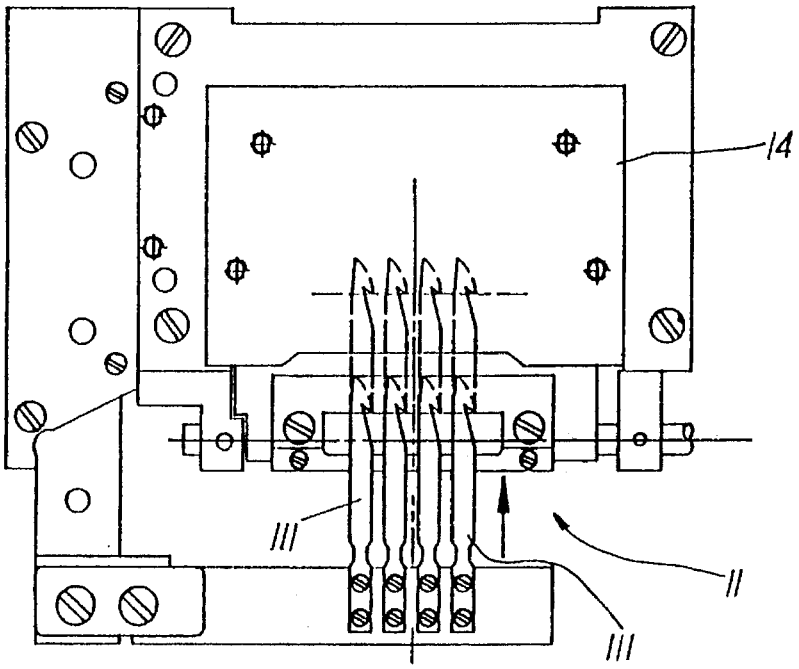
FIG. 8 is a top plan view showing the movable catchers of the cutting part of the under trimming device at the initial positions (as shown by the solid line) and at the extended positions to a dead point thereof (as shown by the phantom line)
Figure 9:
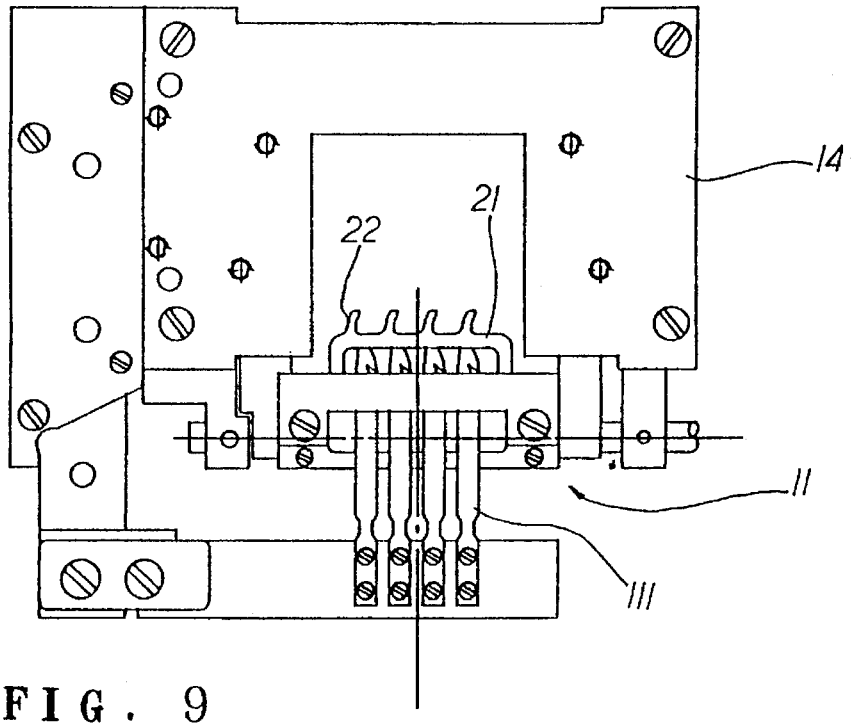
FIG. 9 is a top plan view showing the movable catchers of the present invention being moved forward relative to other neighboring parts of the sewing machine.

Please first refer to FIGS. 3, 4, 8, 9, 10, and 11 at the same time. When the sewing of a workpiece is completed and needle threads and looper threads are to be cut to remove the workpiece from the sewing machine, the needles stop at an upper dead point of their vertically reciprocating travel (not shown) so that the under trimming device 10 should not contact and come into collision with the needles. At this point, the lower clamping part 12 is moved to a position close to the cutting part 11 with the loopers 121 becoming parallel to the needle plate 14 in a horizontal position, as shown in FIG. 11, and the movable catchers 111 of the cutting part 11 are located at their initial positions, as shown in FIGS. 3 and 8. When the transmission mechanism 13 is started up and drives the cutting part 11 to move, the movable catchers 111 are brought to move toward the loopers 121, as shown in FIG. 9, until they finally reach a dead point of their travel, as shown in FIGS. 4 and 8. From the dead point, the movable catchers 111 move back to their initial positions again. When the movable catchers 111 move forward toward the needle plate 14, they pass through the middle opening of the thread push plate 21. The actions of clamping and cutting needle threads and looper threads by the under trimming device 10 are completed during the reciprocating movements of the movable catchers 111 and the clamping part 12.

Figure 12:
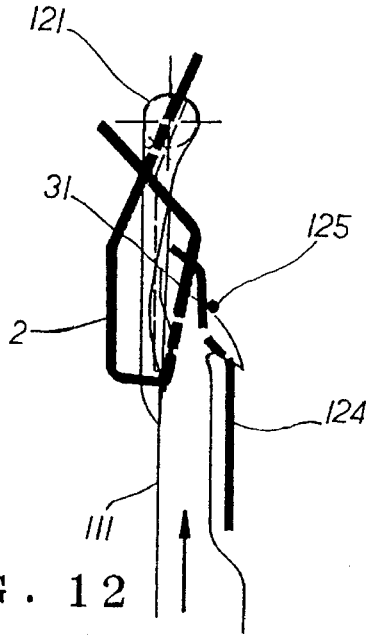
FIG. 12 is a fragmentary, enlarged, top plan view showing the movable catcher of the present invention moving toward a loop formed from the looper thread.
Figure 13:
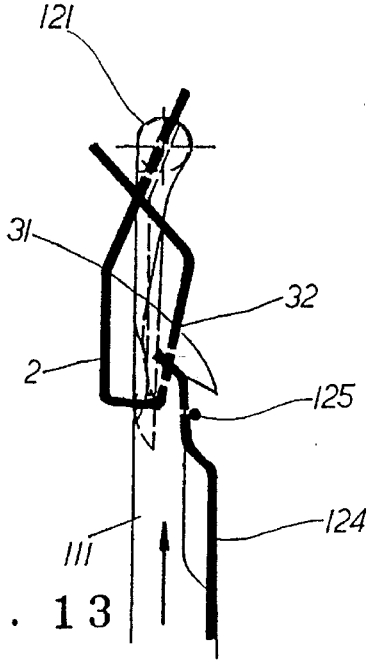
FIG. 13 is similar to FIG. 12 but with the movable catcher just moving into the loop formed from the looper thread.
Figure 14:
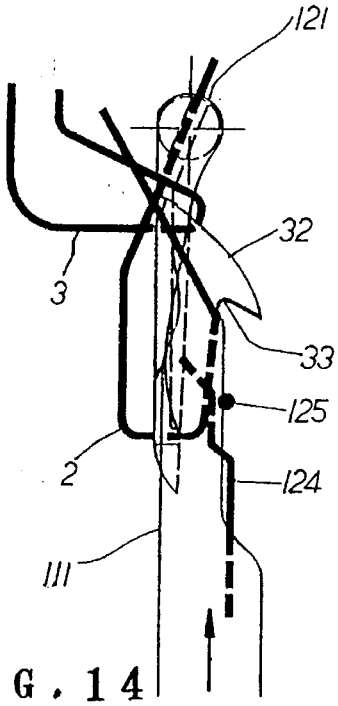
FIG. 14 is a fragmentary, enlarged, top plan view showing the movable catcher having moved into the loop formed from the looper thread and keeping moving toward a loop formed from the needle thread.
Figure 15:
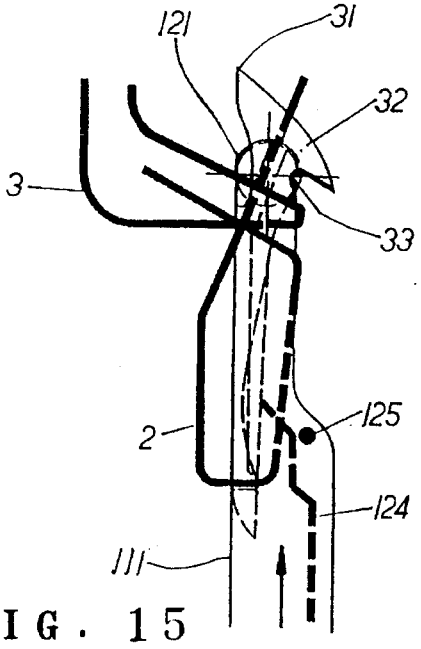
FIG. 15 is similar to FIG. 14 but with the movable catcher moved into the loop formed from the needle thread and reaching a dead point in its forward travel.
Figure 16:
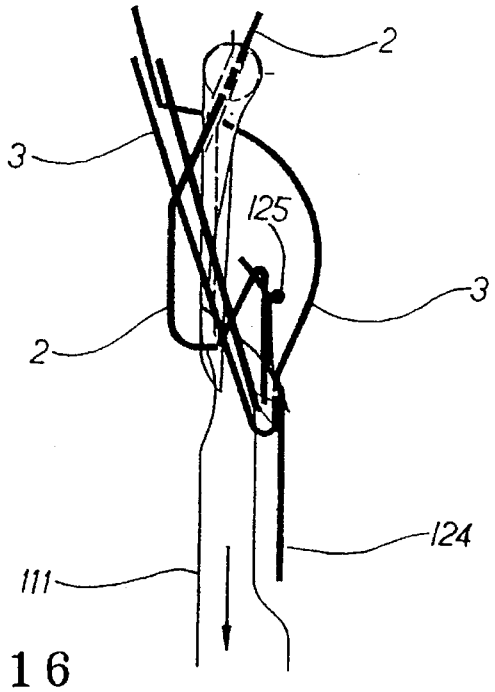
FIG. 16 is a fragmentary, enlarged, top plan view showing that the movable catcher has caught the needle threads and the looper threads and moves backward to its initial position so that the looper thread is clamped between the leaf spring and the holding pin of the looper thread claw.

Please refer to FIGS. 12 to 16. The movable catcher 111 each moves in a small clearance between the thread push plate 21 and its corresponding looper 121. To start thread cutting, the transmission mechanism 13 drives the movable catchers 111 to extend toward the needle plate 14. A pointed end 31 of each movable catcher 111 moves toward a loop formed by the looper thread 2 threading through the rear hole of the corresponding looper 121, as shown in FIGS. 12 and 13. Due to the laterally reciprocating movement of the thread push plate 21, the looper thread 2 is pushed rightward and leftward by the thread push plate 21 to form a widely expanded loop to enable the pointed end 31 of the movable catcher 111 to easily extend through the loop formed by the looper thread 2. At this point, the movable catcher 111 keeps moving forward and sets apart and extends through the needle thread loop formed by the needle thread 3 corresponding to the particular movable catcher 111. As shown in FIG. 14, the looper thread 2 slides over a projected edge portion 32 of the movable catcher 111 and into a recess portion 33 behind the projected edge portion 32 when the movable catcher 111 keeps moving forward. When the movable catcher 111 moves to the dead point of its forward travel, both the needle thread 3 and the looper thread 2 are to be hooked and held in the recess portion 33 of the movable catcher 111, as shown in FIG. 15. At this point, the movable catcher 111 starts to move back to its initial position. When the movable catcher 111 is moving backward from the dead point on its backward travel, the looper thread 2 is guided into a gap between the claw leaf spring 124 and the holding pin 125 and is clamped thereto. At this point, the movable catcher 111 keeps moving backward and thereby pulls the needle thread 3 and the looper thread 2 to move toward the fixed cutter 115. When the needle thread 3 and the looper thread 2 come into contact with the fixed cutter 115, they are cut off at the same time, as shown in FIG. 16. However, the free end of the cut looper thread 2 has been clamped by the assembly 120. Since the loopers 121 and the movable catchers 111 of the present invention reciprocate in the same longitudinal direction during the trimming operation, the cut needle threads 3 and the cut looper threads 2 leave free ends of the same length which facilitate a successful start of the next sewing.

The above description and accompanying drawings are only used to illustrate a preferred embodiment of the present invention, not intended to limit the scope thereof. Many modifications of the embodiment can be made without departing from the spirit of the present invention. For example, the various components and parts of the present invention can be connected to one another by any other means known by the art instead of using screws only.

BRIEF DESCRIPTION OF THE REFERENCE NUMERALS

| | |
|---|---|
| 2 looper thread | 3 needle thread |
| 10 under trimming device | 11 cutting part |
| 12 clamping part | 13 transmission mechanism |
| 14 needle plate | 21 thread push plate |
| 22 fingers | 23 transmission shaft |

-continued

| BRIEF DESCRIPTION OF THE REFERENCE NUMERALS | |
|---|---|
| 30 air blower | 31 pointed end |
| 32 projected edge portion | 33 recess portion |
| 111 movable catchers | 112 movable catcher holder |
| 113 L-shaped connecting member | 114 link |
| 115 fixed cutter | 116 H-shaped fixed cutter holder |
| 117 leaf spring mount | 118 leaf springs |
| 120 looper thread claw assemblies | 121 looper |
| 122 looper thread claw | 123 claw base |
| 124 claw leaf spring | 125 holding pin |
| 126 mounting block | |

What is claimed is:

1. An under trimming device for a multi-needle sewing machine with multiple longitudinally extended loopers, being disposed in an end portion of a bed of said sewing machine below a needle plate and needles thereof, comprising:

a cutting part being disposed in front of said needle plate and including a plurality of movable catchers fixedly mounted on a movable catcher holder which is connected to a transmission mechanism of said sewing machine via a link, such that said movable catchers mounted thereon longitudinally reciprocate when said movable catcher holder is driven by said transmission mechanism, and a fixed cutter fixedly mounted on a fixed cutter holder and thereby connected to a front edge of said needle plate, said fixed cutter holder further having a leaf spring mount mounted thereon to receive a plurality of leaf springs which press against bottom sides of said movable catchers to hold said movable catchers in a horizontal position, said leaf springs having a number and position corresponding to those of said movable catchers; and a clamping part being disposed beneath said needle plate to correspondingly face said cutting part and including a plurality of looper and looper thread claw assemblies which each consists of a looper, a claw leaf spring, and a holding pin abutting against said claw leaf spring, all being mounted on a claw base, said looper and looper thread claw assemblies being fixedly mounted on a mounting block which is connected to a looper driving mechanism of said sewing machine and thereby causes said assemblies to reciprocate longitudinally;

wherein when a trimming operation is to be done, said a plurality of movable catchers are driven by said transmission mechanism to move longitudinally and horizontally toward said needle plate while said loopers are parallel to said needle plate in a horizontal position, such that multiple sets of looper thread loops and corresponding needle thread loops are separately extended through by said forward moving movable catchers and slide into a recess portion of said movable catchers and are held thereto when said movable catchers move toward a dead point on their forward travel, and, when said movable catchers are moving back from said dead point to their initial position, said looper threads are guided into a gap between said claw leaf spring and said holding pin and clamped thereto so that when said movable catchers return to their initial position, said needle threads and said looper threads are cut off at the same time.

2. The under trimming device for a multi-needle sewing machine with multiple longitudinally extended loopers as claimed in claim 1, further comprises an integrally formed thread push plate having a plurality of fingers at a front edge thereof and being connected to a transmission shaft disposed in front of said needle plate of said sewing machine, whereby when said transmission shaft is driven by said transmission mechanism of said sewing machine to reciprocate rightward and leftward, said loops formed from said looper threads being widely expanded by said fingers, allowing said movable catchers to extend into said loops more easily.

3. The under trimming device for a multi-needle sewing machine with multiple longitudinally extended loopers as claimed in claim 1, further comprises an air blower disposed to one side of said needles of said sewing machine for blowing said free ends of said cut needle threads sideward in the opposite direction to facilitate a next sewing operation.

4. The under trimming device for a multi-needle sewing machine with multiple longitudinally extended loopers as claimed in claim 1, wherein said transmission mechanism for driving said cutting part is pneumatically driven.

5. The under trimming device for a multi-needle sewing machine with multiple longitudinally extended loopers as claimed in claim 1, wherein said transmission mechanism for driving said cutting part is electromagnetically driven.

* * * * *

UNITED STATES PATENT AND TRADEMARK OFFICE

CERTIFICATE OF CORRECTION

PATENT NO. : 5,551,359

DATED : September 3, 1996

INVENTOR(S) : Kenji IKEDA et al.

It is certified that error appears in the above-identified patent and that said Letters Patent is hereby corrected as shown below:

In column 1, line 20, please delete the "-" after the word "a".

In column 1, line 36, please delete the "-" after the second occurrence of "the".

In column 2, line 33, please delete "invent ion" and insert in lieu thereof --invention--.

In column 3, line 21, please delete "invent ion" and insert in lieu thereof --invention--.

Signed and Sealed this

Fourth Day of February, 1997

*Attest:*

Bruce Lehman

BRUCE LEHMAN

*Attesting Officer*

*Commissioner of Patents and Trademarks*